US008926824B2

(12) United States Patent
Morel

(10) Patent No.: US 8,926,824 B2
(45) Date of Patent: Jan. 6, 2015

(54) PROCESS FOR THE CONVERSION OF RESIDUE INTEGRATING MOVING-BED TECHNOLOGY AND EBULLATING-BED TECHNOLOGY

(75) Inventor: Frédéric Morel, Chatou (FR)

(73) Assignee: IFP Energies Nouvelles, Rueil-Malmaison Cedex (FR)

( * ) Notice: Subject to any disclaimer, the term of this patent is extended or adjusted under 35 U.S.C. 154(b) by 746 days.

(21) Appl. No.: 12/910,360

(22) Filed: Oct. 22, 2010

(65) Prior Publication Data

US 2011/0094938 A1 Apr. 28, 2011

(30) Foreign Application Priority Data

Oct. 23, 2009 (FR) ..... 09 05108

(51) Int. Cl.
*C10G 65/02* (2006.01)
*C10G 65/12* (2006.01)

(52) U.S. Cl.
CPC ..... *C10G 65/12* (2013.01); *C10G 2300/4018* (2013.01); *C10G 2300/107* (2013.01); *C10G 2300/1077* (2013.01); *C10G 2300/202* (2013.01); *C10G 2300/205* (2013.01); *C10G 2300/301* (2013.01); *C10G 2300/4006* (2013.01); *C10G 2300/4012* (2013.01)
USPC ..... 208/49

(58) Field of Classification Search
CPC ..... C10G 47/24; C10G 45/18; C10G 65/12
USPC ..... 208/49, 59, 213, 216
See application file for complete search history.

(56) References Cited

U.S. PATENT DOCUMENTS

| | | | | |
|---|---|---|---|---|
| 4,354,852 | A | 10/1982 | Kydd | |
| 4,389,301 | A * | 6/1983 | Dahlberg et al. | 208/59 |
| 4,457,831 | A | 7/1984 | Gendler | |
| 4,495,060 | A | 1/1985 | Abrams | |
| 4,521,295 | A | 6/1985 | Chervenak et al. | |
| 6,086,749 | A * | 7/2000 | Kramer et al. | 208/213 |
| 2004/0004030 | A1 * | 1/2004 | Gibson et al. | 208/216 PP |

OTHER PUBLICATIONS

Institut National De La Propriete Industrielle. "Search Report." FR0905108. Examiner: Michele Cagnoli, Applicant: IFP. Mailed: Jun. 14, 2010.

(Continued)

*Primary Examiner* — Prem C Singh
*Assistant Examiner* — Brandi M Doyle
(74) *Attorney, Agent, or Firm* — Millen, White, Zelano & Branigan, P.C.

(57) ABSTRACT

The invention describes a process for the conversion of heavy carbon-containing fractions having an initial boiling point of at least 300° C. to upgradable lighter products, said process comprising passage of said feed through a hydrorefining reaction zone comprising at least one moving-bed reactor, and passage of at least a portion of the effluent from stage a) through a hydroconversion reaction zone comprising at least one three-phase reactor, in the presence of hydrogen, said reactor containing at least one hydroconversion catalyst and operating in ebullating-bed mode, with an ascending current of liquid and gas and comprising at least one means of withdrawing said catalyst out of said reactor and at least one means of adding fresh catalyst into said reactor, under conditions making it possible to obtain a liquid feed with a reduced content of Conradson carbon, metals, sulphur and nitrogen.

14 Claims, 1 Drawing Sheet

(56) References Cited

OTHER PUBLICATIONS

Al-Dalama, K. And A Stanislaus. "Comparison between deactivation pattern of catalysts in fixed-bed and ebullating-bed residue hydroprocessing units." (Chemical Engineering Journal), Jul. 2006, pp. 33-42, vol. 120, No. 1-2.

Eccles, Richard M. "Residue hydroprocessing using ebullated-bed reactors." (Fuel Processing Technology), Sep. 1993, pp. 21-38, vol. 35, No. 1-2.

Scheuerman et al. "Advances in Chevron RDS technology for heavy oil upgrading flexibility." (Fuel Processing Technology), Sep. 1993, pp. 39-54, vol. 35., No. 1-2.

* cited by examiner

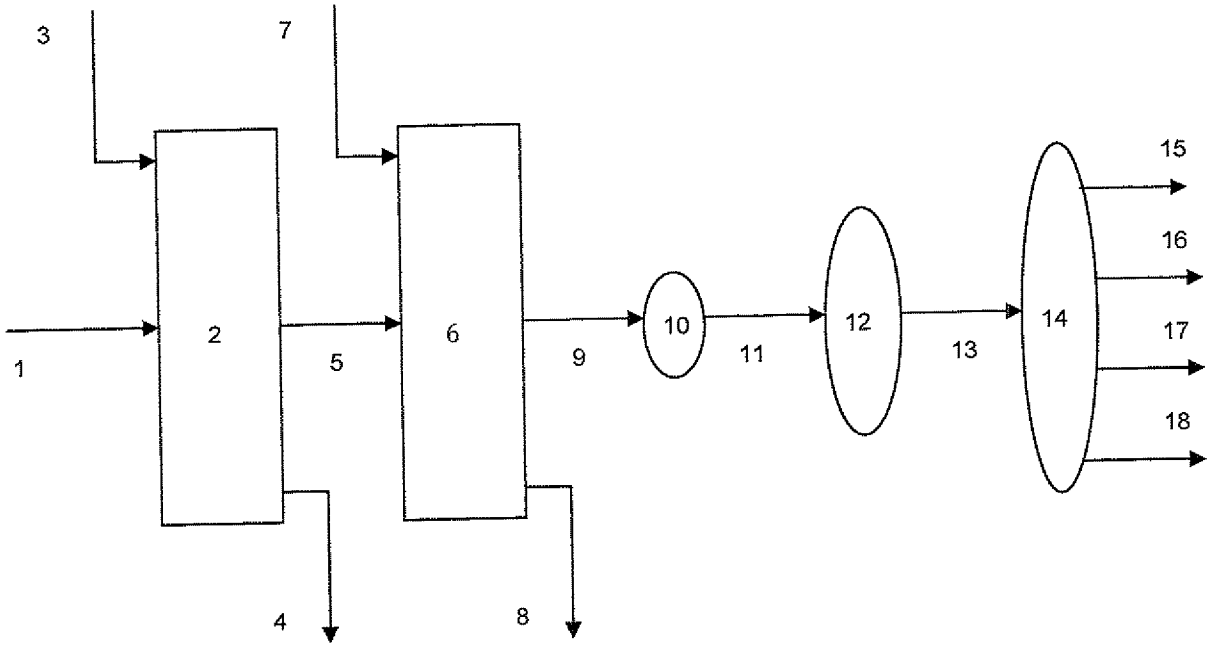
1
2
3
4
5
6
7
8
9
10
11
12
13
14
15
16
17
18

PROCESS FOR THE CONVERSION OF RESIDUE INTEGRATING MOVING-BED TECHNOLOGY AND EBULLATING-BED TECHNOLOGY

The invention relates to the refining and conversion of heavy carbon-containing fractions optionally containing among other things sulphur-containing impurities (for example having an initial boiling point of at least 300° C. such as a petroleum residue, derivatives originating from biomass, coal) to lighter products, upgradable as fuels. It relates more particularly to a process for at least partly converting a hydrocarbon feedstock, and in particular a petroleum residue to upgradable lighter products while improving the properties and the stability of the unconverted heavy residues.

More precisely, the carbon-containing feeds in question are heavy hydrocarbon (petroleum) feeds such as petroleum residues, crudes, topped crudes, deasphalted oils, asphalts from deasphalting, derivatives from petroleum converting processes (e.g. HCO, FCC slurry, heavy GO/coking VGO, residue from visbreaking or similar thermal processes, etc.), oil sands or their derivatives, oil shales or their derivatives, or non-petroleum feeds such as gaseous and/or liquid derivatives (with little or no solids content) from thermal conversion (with or without catalyst and with or without hydrogen) of coal, biomass or industrial wastes such as recycled polymers.

More generally, the term "heavy hydrocarbon feed", to be treated within the scope of the present invention, covers atmospheric residues from direct distillation, obtained by atmospheric and vacuum distillation of a crude oil. These feeds are usually hydrocarbon fractions having a sulphur content of at least 0.5%, preferably at least 1% and more preferably at least 2 wt. %, a content of Conradson carbon. of at least 3 wt. % and preferably at least 10 wt. %, a metals content of at least 20 ppm and preferably at least 100 ppm and an initial boiling point of at least 300° C., preferably at least 360° C. and more preferably at least 370° C. and a final boiling point of at least 500° C., preferably at least 550° C., more preferably above 600° C. and very preferably 700° C.

Preferably, the feeds that are treated within the scope of the present invention are atmospheric residues corresponding to a 380° C.+cut, vacuum residues corresponding to a 560° C.+cut and deasphalted oils (DAO) corresponding to a lighter 560° C.+cut.

For their part, the feeds resulting from thermal conversion, with or without catalyst, and with or without hydrogen, generally contain less than 50% of product distilling above 350° C. and very little or no metals of vanadium and/or nickel type, low asphaltene content, i.e. a content advantageously below 10 wt. % and preferably below 5 wt. % of heptane asphaltenes, and preferably below 2 wt. % of asphaltenes, but they contain oxygen-containing molecules with an oxygen content advantageously between 0.5 and 50 wt. %; nitrogen-containing molecules, predominantly basic, with a nitrogen content advantageously between 0.2 and 2 wt. % and aromatic molecules that are difficult to convert in fixed-bed hydrotreatment/hydroconversion processes, as well as metals that are harmful to catalysts such as alkali metals (Na, Ca, K for example) or silicon.

An objective of the invention is to provide a process for converting carbon-containing feeds and preferably heavy hydrocarbon fractions having an initial boiling point of at least 300° C. to upgradable lighter products, by integrating moving-bed technology and ebullating-bed technology, said process making it possible to maximize the refining of the feed while increasing the conversion of the feed.

PRIOR ART

Globally, the use of fixed-bed reactors still greatly exceeds that of ebullating-bed reactors. Fixed-bed systems are used essentially for the treatment of naphthas, middle distillates, atmospheric and vacuum gas oils and atmospheric residues and vacuum residues. The advantage of fixed-bed processes is that high refining performance is obtained because of the high catalytic efficiency of fixed beds. However, above a certain metals content in the feed (for example 100 to 150 ppm), even though using the best catalytic systems, it is found that the performance and especially the operating time of these processes become inadequate: the reactors quickly become loaded with metals and are therefore deactivated. In order to compensate for this deactivation, the temperatures are increased, which promotes the formation of coke and an increase in pressure losses.

As a result, it therefore becomes necessary to stop the unit at least every 3 to 6 months to replace the first catalyst beds that have become deactivated or clogged, this operation can take up to 3 weeks and thus reduces the utilization factor of the unit.

Thus, when the feed becomes heavier, when it has a higher level of impurities or requires more severe levels of conversion, the fixed-bed system becomes less effective and less profitable. In this case, the ebullating-bed reaction systems are more suitable for said treatment.

In general, ebullating-bed reactors are used for treating feed streams constituted by heavy residues, in particular feeds with high contents of metals and Conradson residues. During the ebuliating-bed process, concurrent streams of liquid, or of suspensions of liquids and solids, and of gases are passed over an elongated vertical three-phase fluidized catalyst bed. The catalyst is fluidized and completely mixed by the upward-flowing streams of liquid. The ebullating-bed process finds commercial application in the conversion and upgrading of heavy liquid hydrocarbons and the conversion of coal to synthetic oils.

The ebullating-bed reactor and the associated process are described in a general way in U.S. Pat. No. 25,770 of Johanson mentioned here as reference. A mixture of hydrocarbon-containing liquid and hydrogen is passed upwards through a bed of catalyst particles at a flow rate such that the particles are subjected to a forced random motion whereas the liquid and the gas travel upwards through the bed. The motion of the catalyst bed is controlled by a recycled liquid stream in such a way that, in steady-state conditions, the mass of the catalyst does not increase above a definable level in the reactor. Vapours and the liquid in the process of being hydrogenated pass through the upper level of the bed of catalyst particles and reach a zone that is more or less catalyst-free, then they are discharged from the top of the reactor.

Ebullating-bed reactors are generally operated at relatively high temperatures and pressures in order to treat these heavy feeds. Ebullating-bed technologies use supported catalysts in the form of extrudates of which diameter is of the order of 1 mm. The catalysts remain inside the reactors and are not discharged with the products. The temperature levels are high in order to obtain high degrees of conversion while minimizing the quantities of catalysts employed.

Ebullating-bed technology generally uses high temperature levels to minimize the quantities of catalysts and requires a low degree of hydrogen cover. The catalytic activity can be kept constant by in-line replacement of the catalyst, therefore it is not necessary to increase the reaction temperatures during the operating cycle. Recycling of the liquid provides bubbling of the catalyst bed, maintenance of a uniform temperature in the reactor and stabilization of the catalyst bed.

Ebullating-bed technology is therefore generally used in order to obtain long operating cycles of the unit and for maximizing the level of conversion of the feed at the expense of the objective of refining the products. Use of a perfectly agitated reactor means that it is possible to replace the catalyst while keeping the unit in operation but leads to degradation of refining performance relative to the performance obtained using the fixed-bed reactor.

Moving-bed technology is also used for the hydrotreatment of petroleum residues. It is particularly suitable for the treatment of feeds with high contents of metals and permits their capture. For example, a process flowsheet can include one or more moving-bed reactors in series loaded with catalysts essentially for hydrodemetallization followed by one or more fixed-bed reactors in series essentially containing catalysts for hydrodemetallization and for hydrodesulphurization. The spent catalysts in the moving-bed reactor are advantageously withdrawn at the bottom of said reactor. Said spent catalysts are saturated with metals (Ni+V), whereas in the case of fixed beds, only the upper part of the catalyst bed is saturated with metals. This results in a lower catalyst consumption for the moving-bed reactors, especially in the case of counterflow moving-bed reactors.

(Reynolds B. E., Bechtel R. W., Vagi K. (1992) *Chevron's onstream catalyst replacement* (*OCR*). *NPRA meeting New Orleans*)

Said moving-bed technology uses reactors in which a device permits semi-continuous renewal of the catalyst in the reactor, making it possible to keep the catalytic activity constant. The moving-bed technology generally uses temperature levels equivalent to the fixed-bed technology but lower than the ebullating-bed technology. However, just as for the fixed-bed technology, it is necessary to control the exothermic effects of the reactions in each reactor by injection of quench, usually gas, but it is not necessary to increase the reaction temperatures during the operating cycle, said temperatures being identical at the start and at the end. In fact, moving-bed technology permits continuous operation by withdrawal of the spent catalyst and its replacement with fresh catalyst. However, these operations of catalyst replacement can cause entrainment of fines, which may be deposited on the fixed-bed catalysts located downstream, causing an increase in pressure loss. The principal advantage of the moving bed is its capacity for treating, in long cycle times, feeds with high contents of metals. Catalyst consumption is lower than for the other processes. Product yields and quality are similar to those with fixed beds for the same operating conditions.

Moving-bed technology therefore makes it possible to maximize the refining of the feeds used and in particular hydrodenitrogenation, hydrodesulphurization, deasphaltenization and especially thorough demetallization, while maintaining a low degree of conversion of the feed.

Implementation of a process for the conversion of carbon-containing feeds and preferably heavy hydrocarbon fractions having an initial boiling point of at least 300° C. to upgradable lighter products, integrating moving-bed technology and ebullating-bed technology, therefore offers clear synergies in performance level so that it becomes possible to achieve objectives that are otherwise unattainable by the two technologies considered separately. In fact, the process according to the invention makes it possible to maximize the refining of the feed by employing at least one moving-bed reactor, said moving bed being installed upstream of at least one ebullating-bed reactor permitting an increase in conversion of the feed.

DESCRIPTION OF THE INVENTION

The present invention therefore describes a process for converting carbon-containing feeds to upgradable lighter products, said process having the following stages:

a) passage of said feed through a hydrorefining reaction zone with at least one moving-bed reactor comprising at least one catalyst bed of hydrorefining catalyst and at least one means of withdrawing said catalyst out of said reactor and at least one means of adding fresh catalyst to said reactor, said catalyst circulating by gravity and in piston flow within said reactor, said stage a) of hydrorefining operating at an absolute pressure between 10 and 24 MPa, at a temperature between 300 and 440° C., at an hourly space velocity (HSV) between 0.1 and 4 h-1 and with a quantity of hydrogen mixed with the feed between 100 and 2000 Normal cubic metres (Nm3) per cubic metre (m3) of liquid feed.

b) passage of at least a portion of the effluent from stage a) through a hydroconversion reaction zone comprising at least one three-phase reactor, in the presence of hydrogen, said reactor containing at least one catalyst bed of hydroconversion catalyst and operating in ebullating-bed mode, with ascending current of liquid and gas and comprising at least one means of withdrawing said catalyst out of said reactor and at least one means of adding fresh catalyst to said reactor, under conditions making it possible to obtain a liquid feed with reduced content of Conradson carbon, metals, sulphur and nitrogen, said stage b) operating at an absolute pressure between 2 and 35 MPa, at a temperature between 300 and 550° C., at an HSV between 0.1 h-1 and 10 h-1 and with a quantity of hydrogen mixed with the feed between 50 and 5000 normal cubic metres (Nm3) per cubic metre (m3) of liquid feed.

The present invention therefore has the objective of supplying a process for converting carbon-containing feeds and preferably heavy hydrocarbon fractions having an initial boiling point of at least 300° C. to upgradable lighter products, integrating moving-bed technology and ebullating-bed technology, said process making it possible to maximize the refining of the feed while increasing the conversion of the feed.

DETAILED DESCRIPTION OF THE INVENTION

In accordance with stage a) of the process according to the invention, the carbon-containing feed, preferably constituted by a heavy hydrocarbon fraction having an initial boiling point of at least 300° C. passes through a hydrorefining reaction zone comprising at least one moving-bed reactor and at least one means of withdrawing said catalyst out of said reactor and at least one means of adding fresh catalyst to said reactor.

The temperatures are advantageously controlled by hydrogen quench arranged between the reactors and/or between the beds of each reactor.

The moving-bed technology uses a system for semi-continuous renewal of the catalyst by supplying fresh catalyst at the top of each reactor and by withdrawal of spent catalyst at the bottom of each reactor. Special equipment known to a person skilled in the art is provided for reliable transfer of the catalyst under conditions of high temperature and high pressure.

Inside the moving-bed reactor or reactors, the catalyst circulates according to the invention, by gravity and in piston flow. Preferably, spherical catalysts are used with diameter between 0.5 and 6 mm and preferably between 1 and 3 mm rather than extruded catalysts, in order to obtain better flow.

During withdrawal of the spent catalyst at the bottom of the reactor, the entire catalyst bed moving in piston flow is displaced downwards from a height corresponding to the volume of catalyst withdrawn.

The degree of expansion of the catalyst bed operating as a moving bed is advantageously less than 15%, preferably less than 10%, more preferably less than 5% and most preferably less than 2%. The degree of expansion is measured by a method known to a person skilled in the art.

According to a very preferred embodiment, the degree of expansion of the catalyst bed operating as a moving bed is less than 2% and preferably the bed is not expanded. In fact, during withdrawal of the spent catalyst at the bottom of said reactor, it is the entire bed that moves in piston flow downwards, from a height corresponding to the volume of catalyst withdrawn.

Once catalyst makeup and withdrawal have been carried out, said reactor behaves as an unexpanded fixed bed.

The spent catalysts, saturated with metals (Ni+V), are advantageously withdrawn at the bottom of the moving-bed reactors.

According to the invention, stage a) of hydrorefining of said feed is carried out under conventional conditions of moving-bed hydrorefining of a liquid hydrocarbon fraction. According to the invention, operation is at an absolute pressure between 10 and 24 MPa, preferably between 5 and 25 MPa and more preferably between 6 and 20 MPa, at a temperature between 300 and 440'C and preferably between 370 and 410° C. The hourly space velocity (HSV) and the hydrogen partial pressure are important factors, which are selected depending on the characteristics of the product to be treated and the desired conversion.

The HSV is preferably between 0.1 and 4 $h^{-1}$ and more preferably between 0.2 and 2 $h^{-1}$. The quantity of hydrogen mixed with the feed is preferably between 100 and 2000 Normal cubic metres ($Nm^3$) per cubic metre ($m^3$) of liquid feed and preferably between 50 and 5000 $Nm^3/m^3$ and very preferably between 200 and 1000 $Nm^3/m^3$.

The hydrorefining catalyst used in stage a) of the process according to the invention is advantageously a catalyst comprising a support, preferably amorphous and very preferably alumina and at least one group VIII metal selected from nickel and cobalt and preferably nickel, said group VIII element preferably being used in combination with at least one group VIB metal selected from molybdenum and tungsten, and preferably the group VIB metal is molybdenum.

Preferably, the hydrorefining catalyst comprises nickel as group VIII element and molybdenum as group VIB element. The nickel content is advantageously between 0.5 and 10% expressed as weight of nickel oxide (NiO) and preferably between 1 and 6 wt. % and the molybdenum content is advantageously between 1 and 30% expressed as weight of molybdenum trioxide ($MoO_3$), and preferably between 4 and 20 wt. %, the percentages being expressed as percentage by weight relative to the total weight of the catalyst. Said catalyst is advantageously in the form of extrudates or beads.

This catalyst can also advantageously contain phosphorus and preferably a content of phosphorus oxide $P_2O_5$ below 20% and preferably below 10 wt. %, the percentages being expressed as percentage by weight relative to the total weight of the catalyst. Preferably, the hydrorefining catalyst is of spherical shape, with diameter between 0.5 and 6 mm and preferably between 1 and 3 mm.

The hydrorefining catalyst used in stage a) of the process according to the invention advantageously provides both demetallization and desulphurization, under conditions making it possible to obtain a liquid feed with reduced content of metals, Conradson carbon and sulphur.

The moving-bed reactors operate advantageously either in descending co-current of the fluids (i.e. down-flow mode), and in this case stage a) of the process according to the invention is advantageously applied in the conditions of the Shell process with reactors of the Bunker type described in Scheffer et al. 1998, or with ascending co-current of the fluids, also called counter-current (i.e. up-flow mode), in which the catalyst circulates from the top to the bottom of the reactor and the reacting fluids circulate from the bottom to the top of the reactor, in counter-current to the catalyst. In the second case, stage a) of the process according to the invention is advantageously applied under the conditions of the process described in Reynolds B. E., Bechtel R. W., Yagi K. (1992) *Chevron's onstream catalyst replacement* (*OCR*). *NPRA meeting New Orleans*.

According to stage b) of the process according to the invention, at least a portion and preferably all of the effluent from stage a) passes through at least one three-phase reactor, in the presence of hydrogen, said reactor containing at least one hydroconversion catalyst and operating in ebullating-bed mode, with ascending current of liquid and gas and comprising at least one means of withdrawing said catalyst out of said reactor and at least one means of adding fresh catalyst to said reactor, under conditions making it possible to obtain a liquid feed with reduced content of Conradson carbon, metals, sulphur and nitrogen.

The ascending mixture of liquid hydrocarbon and hydrogen gas advantageously passes through a bed of catalyst particles at a flow rate such that the catalyst particles are subjected to a forced random motion whereas the liquid and the gas travel upwards through the bed. The flow of the mixture and in particular the flow of gas cause the catalyst bed to expand. The degree of expansion of the catalyst bed in a reactor operating in ebullating-bed mode is advantageously greater than 30%, the degree of expansion being measured by a process known to a person skilled in the art.

Moreover, as the ebullating-bed technology is widely known, only the main operating conditions will be noted here.

According to the invention, stage b) of hydroconversion of said effluent from stage a) of the process according to the invention is generally carried out under conventional conditions of ebullating-bed hydroconversion of a liquid hydrocarbon fraction. According to the invention, operation is usually at an absolute pressure between 2 and 35 MPa, preferably between 5 and 25 MPa and more preferably between 6 and 20 MPa, at a temperature between 300 and 550° C. and preferably between 350 and 500° C. The hourly space velocity (HSV) and the hydrogen partial pressure are important factors that are selected depending on the characteristics of the product to be treated and the desired conversion. The HSV is preferably between 0.1 $h^{-1}$ and 10 $^{-1}$ and more preferably between 0.15 $h^{-1}$ and 5 $^{-1}$. The quantity of hydrogen mixed with the feed is preferably between 50 and 5000 normal cubic metres ($Nm^3$) per cubic metre ($m^3$) of liquid feed and more preferably between 100 and 2000 $Nm^3/m^3$ and very preferably between 200 and 1000 $Nm^3/m^3$.

The catalysts used are marketed widely. They are granular catalysts with particle size of the order of 1 mm or less. The hydroconversion catalyst used in stage b) of the process according to the invention is advantageously a catalyst comprising a support, preferably amorphous and very preferably alumina and at least one group VIII metal selected from nickel and cobalt and preferably nickel, said group VIII element preferably being used in combination with at least one group VIB metal selected from molybdenum and tungsten, and preferably the group VIB metal is molybdenum.

Preferably, the hydroconversion catalyst comprises nickel as group VIII element and molybdenum as group VIB element. The nickel content is advantageously between 0.5 and 10% expressed as weight of nickel oxide (NiO) and preferably between 1 and 6 wt. % and the molybdenum content is advantageously between 1 and 30% expressed as weight of molybdenum trioxide ($MoO_3$), and preferably between 4 and 20 wt. %. This catalyst is advantageously in the form of extrudates or beads.

This catalyst can also advantageously contain phosphorus and preferably has a content of phosphorus oxide $P_2O_5$ below 20% and preferably below 10 wt. %.

Preferably, the catalyst is in the form of extrudates or beads.

The spent hydroconversion catalyst can, according to the process of the invention, be replaced partly with fresh catalyst by withdrawal, preferably at the bottom of the reactor and by introducing, either at the top or at the bottom of the reactor, fresh or regenerated or rejuvenated catalyst, preferably at regular time intervals and preferably in bursts or quasi-continuously. The rate of replacement of the spent hydroconversion catalyst with fresh catalyst is advantageously between 0.05 kilogram and 10 kilograms per cubic metre of feed treated, and preferably between 0.3 kilogram and 3 kilograms per cubic metre of feed treated. This withdrawal and this replacement are carried out by means of devices advantageously permitting continuous operation of this hydroconversion stage. The unit usually has a circulating pump to maintain ebullating-bed conditions of the catalyst by continuous recycling of at least a portion of the liquid withdrawn from the top of the reactor and reinjected at the bottom of the reactor.

It is also advantageously possible to send the spent catalyst withdrawn from the reactor to a regeneration zone, in which the carbon and sulphur that it contains are removed, then send this regenerated catalyst to hydroconversion stage b). It is also advantageously possible to send the spent catalyst withdrawn from the reactor to a rejuvenation zone in which the major portion of the deposited metals is removed, before sending the rejuvenated spent catalyst to a regeneration zone in which the carbon and sulphur that it contains are removed, and then send this regenerated catalyst to hydroconversion stage b).

Stage b) of the process according to the invention is advantageously applied in the conditions of the H-OIL process as described for example in patents U.S. Pat. No. 4,521,295 or U.S. Pat. No. 4,495,060 or U.S. Pat. No. 4,457,831 or U.S. Pat. No. 4,354,852 or in the article by Aiche, Mar. 19-23, 1995, Houston, Tex., paper number 46d, Second generation ebullated bed technology.

The hydroconversion catalyst used in stage b) advantageously gives a high degree of conversion to light products, i.e. in particular to gasoline and diesel fuel fractions. Stage b) is advantageously applied in one or more three-phase hydroconversion reactors.

An inter-reactor hydrogen gas quench is advantageously implemented between the hydrorefining reaction zone of stage a) and the hydroconversion reaction zone of stage b) so as to adjust the inlet temperature of the reactor or reactors.

The effluent originating from stage b) of the process according to the invention and preferably from the last ebullating-bed reactor is advantageously sent to at least one separator in series. The liquid fractions from these separators are then advantageously sent to a steam stripping column. The stripped effluent is in its turn then advantageously sent to a column for atmospheric fractionation and then vacuum fractionation to separate it into several cuts: naphtha, middle distillate, vacuum distillate and vacuum residue.

BRIEF DESCRIPTION OF FIG. 1

FIG. 1 shows a preferred embodiment of the invention.

The feed constituted by a heavy hydrocarbon fraction having an initial boiling point of at least 300° C. is sent via pipe (1) to a hydrorefining reaction zone comprising a moving-bed reactor (2), said reactor comprising a means of withdrawing said catalyst out of said reactor via pipe (4) and at least one means of adding fresh catalyst to said reactor via pipe (3).

The effluent obtained at the end of the hydrorefining stage (leaving by pipe 5) is then sent to a hydroconversion reaction zone (6) comprising a three-phase reactor operating in ebullating-bed mode.

Makeup of fresh catalyst is added to the catalyst bed in the ebullating-bed reactor via pipe (7), and an equivalent quantity of spent catalyst is withdrawn from said reactor via pipe (8).

The effluent originating from the hydroconversion reaction zone (6) is then sent to a separator in series (10) via pipe (9). The liquid fraction from the separator is then sent via pipe (11) to a steam-stripping column (12). The stripped effluent is in its turn then sent via pipe (13) to a column for atmospheric fractionation and then vacuum fractionation (14) to separate it into several cuts: naphtha (15), middle distillate (16), vacuum distillate (17) and vacuum residue (18).

EXAMPLE

The examples illustrate the invention without limiting its scope.

Comparative Example

Treatment of a Feed of the Vacuum Residue Type in a Conventional Ebullating-Bed Process The feed is a vacuum residue (VR) from extra heavy crude, with the following properties:

TABLE 1

| Characteristics of the feed | |
|---|---|
| Specific gravity (API Gravity) | 8.30 |
| Nitrogen wt. % | 0.449 |
| Sulphur wt. % | 2.944 |
| Conradson carbon wt. % | 17.17 |
| C7 Asphaltenes wt. % | 6.0 |
| Nickel ppm | 75 |
| Vanadium ppm | 262 |

The entire feed is sent to a unit for hydroconversion in the presence of hydrogen, said section comprising 2 three-phase reactors containing two NiMo/alumina hydroconversion catalysts having NiO content of 3 wt. % and $MoO_3$ content of 10 wt. %, the percentages being expressed relative to the total weight of the catalyst. The section operates as an ebullating bed with ascending current of liquid and gas. The unit comprises two ebullating-bed reactors in series and is equipped with an interstage separator.

The conditions applied in the hydroconversion unit are as follows:

TABLE 2

| Operating conditions applied in the two bubbling-bed reactors | |
|---|---|
| | Ebullating bed |
| T 1st reactor, ° C. | 421 |
| T 2nd reactor, ° C. | 426 |
| Rate of catalyst replacement, kg/t | 1.36 |
| Quantity of hydrogen mixed with the feed Nm3/m3 | 424 |
| HSV (reactor), hr−1 | 0.247 |
| HSV (catalyst), hr−1 | 0.394 |

The effluent originating from the hydroconversion process employing a hydroconversion reaction zone comprising two reactors in series operating in ebullating-bed mode was characterized and the properties of the hydrocarbon cut obtained are shown in Table 3.

TABLE 3

| Characteristics of the hydrocarbon cut obtained | |
|---|---|
| Conversion, wt. % | 65.61 |
| H2 consumption, wt. % | 1.479 |
| HDN, wt. % | 39.18 |
| HDS, wt. % | 82.41 |
| HDAs, wt. % | 48.65 |
| HDCCR, wt. % | 53.62 |
| HDNi, wt. % | 80.20 |
| HDV, wt. % | 87.71 |

Example According to the Invention

The feed described in the preceding example is sent in its entirety to a hydrorefining reaction zone (stage a) comprising a moving-bed reactor with a NiMo/alumina hydrotreatment catalyst having MO content of 3 wt. % and $MoO_3$ content of 10 wt. %, the percentages being expressed relative to the total weight of the catalyst.

The entire effluent from stage a) is sent to a stage b) for hydroconversion in the presence of hydrogen, said section comprising a three-phase reactor containing a NiMo/alumina hydroconversion catalyst with NiO content of 3 wt. % and $MoO_3$ content of 10 wt. %, the percentages being expressed relative to the total weight of the catalyst. The section operates as an ebullating bed with ascending current of liquid and gas.

The conditions applied in the hydrorefining unit (stage a) and in the hydroconversion section (stage b) are as follows:

TABLE 4

| Operating conditions applied in the hydrorefining and hydroconversion unit (stages a and b). | |
|---|---|
| | Ebullating bed |
| T 1st reactor (stage a), ° C. | 395 |
| T 2nd reactor (stage b), ° C. | 440 |
| Rate of catalyst replacement, kg/t | 0.56 |
| Quantity of hydrogen mixed with the feed, Nm3/m3 | 483 |
| HSV (reactor), hr−1 | 0.247 |
| HSV (catalyst), hr−1 | 0.306 |

The effluent originating from the process according to the invention employing a moving-bed hydrorefining reaction zone followed by an ebullating-bed hydroconversion section was characterized and the properties of the hydrocarbon cut obtained are shown in Table 5.

TABLE 5

| Characteristics of the hydrocarbon cut obtained | |
|---|---|
| Conversion 1st reactor wt. % | 66.40 |
| Conversion 2nd reactor wt. % | 65.61 |
| H2 consumption, wt. % | 1.481 |
| H2, Nm3/m3 | 166 |
| HDN, wt. % | 41.73 |
| HDS, wt. % | 82.40 |
| HDAs, wt. % | 66.24 |
| HDCCR, wt. % | 54.83 |
| HDNi, wt. % | 90.01 |
| HDV, wt. % | 93.52 |

Thus, it can be seen that the process according to the invention employing a moving-bed hydrorefining reaction zone followed by an ebullating-bed hydroconversion section gives a hydrocarbon effluent that has lower contents of nitrogen, asphaltenes and metals than a conventional process of the prior art while maintaining increased levels of conversion and a far lower catalyst consumption.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein and of corresponding FR application No. 09/05.108, filed Oct. 23, 2009, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the conversion of carbon-containing feed to upgradable lighter products, said process comprising the following stages (a) and (b):

a) in a hydrorefining stage passing said feed counter-currently through a hydrorefining reaction zone comprising at least one moving-bed reactor having at least one catalyst bed of granular hydrorefining catalyst, withdrawing resultant used hydrorefining catalyst out of said moving-bed reactor, adding fresh catalyst to said moving-bed reactor, circulating said granular hydrorefining catalyst within said moving-bed reactor by gravity and by piston flow within said moving-bed reactor, said hydrorefining operating at an absolute pressure between 10 and 24 MPa, at a temperature between 300 and 440° C., at an hourly space velocity (HSV) between 0.1 and 4 h-1 and with a quantity of hydrogen mixed with the feed between 100 and 2000 Normal cubic meters (Nm3) per cubic meter (m3) of liquid feed, wherein said granular hydrorefining catalyst provides both demetallization and desulphurization, under conditions allowing production of a liquid feed with reduced contents of metals, Conradson carbon and sulphur, and wherein said hydrorefining catalyst is spherical and has a diameter of 0.5 to 6 mm, and wherein said feed comprises heavy hydrocarbon fractions having a sulphur content of at least 0.5%, a content of Conradson carbon of at least 3 wt. %, a metals content of at least 20 ppm and an initial boiling point of at least 300° C., and a final boiling point of at least 500° C., b) passing at least a portion of effluent from said hydrorefining stage a) through a separate hydroconversion reaction zone comprising at least one three-phase reactor, in the presence of hydrogen, said three-phase reactor containing at least one catalyst bed of granular hydroconversion catalyst and operating in ebullating-bed mode, with an ascending current of liquid and gas, withdrawing said granular catalyst out of said three-phase reactor and adding fresh granular catalyst to said three-phase reactor, said three phase reactor operating at an absolute pressure between 2 and 35 MPa, at a temperature between 300 and 550° C., at an HSV between 0.1 h-1 and 10 h-1 and with a quantity of hydrogen mixed with the feed between 50 and 5000 normal cubic meters (Nm3) per cubic meter (m3) of liquid feed, so as to obtain a liquid feed with a reduced content of Conradson carbon, metals, sulphur and nitrogen.

2. A process according to claim 1, characterized in that the carbon-containing feed to stage (a) comprises any of atmospheric residues corresponding to a 380° C.+cut, vacuum residues corresponding to a 560° C.+cut and deasphalted oils (DAO) corresponding to a lighter 560° C.+cut.

3. A process according to claim 1, characterized in that the hydrorefining catalyst used in stage a) is a spherical catalyst with diameter between 1 and 3 mm.

4. A process according to claim 1, characterized in that the degree of expansion of the catalyst bed operating as a moving bed is less than 15%.

5. A process according to claim 4, characterized in that the degree of expansion of the catalyst bed operating as a moving bed is less than 2%.

6. A process according to claim 1, characterized in that the hydrorefining catalyst used in stage a) is a catalyst comprising an amorphous support and at least one group VIII metal selected from nickel and cobalt, said group VIII metal being used in combination with at least one group VIB metal selected from molybdenum and tungsten.

7. A process according to claim 1, characterized in that the hydroconversion catalyst used in stage b) is a catalyst comprising an amorphous support and at least one group VIII metal selected from nickel and cobalt, said group VIII metal being present in combination with at least one group VIB metal selected from molybdenum and tungsten.

8. A process according to claim 1, characterized in that the hydroconversion catalyst comprises nickel as group VIII metal and molybdenum as group VIB element, the nickel content being between 0.5 to 10% expressed as weight of nickel oxide (NiO) and the molybdenum content being between 1 and 30% expressed as weight of molybdenum trioxide ($MoO_3$).

9. A process according to claim 1, characterized in that the degree of expansion of the catalyst bed operating in ebullating-bed mode is greater than 30%.

10. A process according to claim 1, wherein the hydrorefining operating temperature is between 370° C. and 410° C.

11. A process according to claim 1, wherein the hydrorefining catalyst of stage (a) comprises between 4 and 20 weight percent of molybdenum trioxide.

12. A process according to claim 1, wherein the catalyst in stages (a) and (b) have the same composition of catalytic elements.

13. A process according to claim 5, characterized in that the hydroconversion catalyst comprises nickel as group VIII metal and molybdenum as group VIB element, the nickel content being between 0.5 to 10% expressed as weight of nickel oxide (NiO) and the molybdenum content being between 1 and 30% expressed as weight of molybdenum trioxide ($MoO_3$).

14. A process according to claim 13, characterized in that the degree of expansion of the catalyst bed operating in ebullating-bed mode is greater than 30%.

* * * * *